United States Patent [19]

Grims

[11] Patent Number: 4,723,433

[45] Date of Patent: Feb. 9, 1988

[54] METHOD AND APPARATUS FOR DOMING CAN BOTTOMS

[75] Inventor: Conrad M. Grims, Golden, Colo.

[73] Assignee: Adolph Coors Company, Golden, Colo.

[21] Appl. No.: 823,308

[22] Filed: Jan. 28, 1986

[51] Int. Cl.[4] ..... B21D 51/26

[52] U.S. Cl. ..... 72/354; 72/348

[58] Field of Search ..... 72/347, 348, 349, 353, 72/354, 358, 359; 220/66, 70

[56] References Cited

U.S. PATENT DOCUMENTS

| | | | |
|---|---|---|---|
| 1,270,933 | 7/1918 | Elsener | 72/354 |
| 3,730,383 | 5/1973 | Dunn et al. | 220/70 |
| 3,998,174 | 12/1976 | Saunders | 72/348 |
| 4,120,419 | 10/1978 | Saunders | 220/70 |
| 4,151,927 | 5/1979 | Cvacho et al. | 220/70 |
| 4,222,494 | 9/1980 | Lee et al. | 220/66 |
| 4,372,143 | 2/1983 | Elert et al. | 72/343 |

FOREIGN PATENT DOCUMENTS

| | | | |
|---|---|---|---|
| 114248 | 12/1941 | Australia | 72/353 |
| 2508828 | 10/1975 | Fed. Rep. of Germany | 72/358 |
| 47028 | 3/1984 | Japan | 72/347 |
| 1438207 | 6/1976 | United Kingdom | 72/354 |

*Primary Examiner*—Lowell A. Larson

*Attorney, Agent, or Firm*—Klaas & Law

[57] ABSTRACT

A doming assembly for doming the bottom wall of a can body. A bodymaker punch urges a can bottom wall first against a forming ring and then against a domer die. The forming ring forms an outer annular portion of a dome and the domer die forms a central portion of a dome in the can bottom wall. The sequential engagement of the can bottom wall by first the forming ring, then the domer die prevents flower dome formation and axial can body shortening.

16 Claims, 9 Drawing Figures

METHOD AND APPARATUS FOR DOMING CAN BOTTOMS

BACKGROUND OF THE INVENTION

The present invention relates generally to apparatus for doming the bottom walls of cans and, more particularly, to apparatus for doming thin walled aluminum can bodies of the type having a cylindrical side wall and an integrally formed bottom wall.

Metal containers such as cans which are adapted to hold contents under pressure are often provided with a upwardly extending dome in the bottom wall thereof to resist the tendency of the bottom wall to deform excessively under pressure and also to provide a generally planar annular portion at the periphery of the bottom wall which provides a stable support base for the can. Numerous domed containers are described in prior art patents such as U.S. Pat. Nos. 1,963,795; 3,904,069; and 4,037,752 which are hereby incorporated by reference.

In doming the bottom of relatively thin walled metal cans, such as conventional aluminum beer cans, a continuing problem has been the formation of radially extending crease lines in the domed portion of the can. These crease lines are probably formed as a result of non-uniform deformation of the can bottom wall at the time it is initially contacted by a dome-shaped die assembly. The non-uniform deformation may be due to the fact that the die assembly initially makes a point contact at the center of the can bottom resulting in an initial deformation of the can bottom into a conical configuration. It is in the transition of the can bottom from a generally planar shape to such a conical shape that radial creasing of the can bottom takes place. Such a creased dome configuration is generally known in the art as a "flower dome." A problem with flower dome formation, other than the generally aesthetically unacceptable appearance, is that the crease lines may rupture or weaken the can bottom and may cause leaks or non-uniform deformation of the can bottom when the can is pressurized. Another problem associated with dome formation in integrally formed thin walled can bodies is that the deformation of the can bottom wall during doming tends to cause metal flow from the can lateral side wall to the can bottom wall resulting in a slight axial shortening of the can. One prior art technique for eliminating these problems has been to tightly engage a peripheral portion of the can bottom wall and a lower portion of the can side wall between a bodymaker punch assembly and a pressure ring during dome formation. Such a peripheral engagement of the can wall tends to stabilize the bottom wall circumferentially, thereby reducing the tendency of the bottom wall to crease during dome formation. Such a peripheral engagement also tends to limit the flow of metal from the can side wall to the can bottom wall. Another prior art method, sometimes used in combination with a pressure ring, for eliminating flower dome formation is application of relatively high pressure to the domed region of the bottom wall during dome formation to "iron out" any creases that may have been formed during the initial portion of the doming operation. A problem with the former technique is that, in applying sufficient pressure to the periphery of the can bottom to prevent the undesirable effects of can shortening and flower dome formation, the engaged portion of the can bottom is sometimes damaged by the pressure ring. A problem with "ironing out" radial creases is that the ironed out creased area has different strength and deformation characteristics than the other portions of dome. Furthermore, such ironing out techniques are not always successful in removing all of the radial creases.

OBJECTS OF THE INVENTION

It is an object of the present invention to provide an apparatus capable of forming a dome in the bottom wall of a can body without decreasing the axial length of the can body and without introducing radial crease lines in the forming dome.

It is also an object of the present invention to provide a doming apparatus which exerts considerably less pressure on the bottom of a can than conventional pressure ring type doming assemblies and which is less likely to damage the bottom portion of a can during a doming operation than conventional pressure ring assemblies.

It is a further object of the present invention to provide a doming apparatus which engages an external bottom wall portion of a container to be domed with two separate deforming surfaces.

SUMMARY OF THE INVENTION

The present invention may comprise a can doming assembly for producing a dome in the bottom wall of a can body of the type having an open top, a cylindrical sidewall and a generally planar bottom wall integrally formed with the sidewall, the sidewall and bottom wall each having an interior surface and an exterior surface, comprising: punch means insertable into the can body through the open top thereof and engageable with the interior surface of the can bottom wall at a peripheral portion of the can bottom wall for urging the can bottom wall against a forming ring means and a domer die means; forming ring means positioned axially adjacent said punch means for deformingly engaging the exterior surface of the can bottom wall at a circular band portion thereof for forming an outer peripheral portion of a dome in the can bottom wall; domer die means positioned axially adjacent said forming ring means for engaging the exterior surface of the can bottom wall at a central circular portion thereof for forming a central portion of a dome in the can bottom wall; ram means attached to said punch means for reciprocally moving said punch means in a first direction toward said domer die means and a second direction away from said domer die means, said ram means having a first position wherein a can engagedly mounted on said punch means is positioned in axially spaced relationship from said forming ring means and said domer die means, a second position wherein a can engagedly mounted on said punch means is positioned in engaged relationship with said forming ring means and in axially spaced relationship with said domer die means, and a third position wherein a can engagedly mounted on said punch means is positioned in engaged relationship with both said forming ring means and said domer die means; forming ring biased support means for holding said forming ring at a position between said punch means and said domer die means in axially spaced relationship therefrom when said ram means is in said first position and for enabling axial movement of said forming ring means in said first direction during movement of said ram means between said second position and said third position and for exerting a biasing force on said forming ring means in said second direction during movement of said ram means between said second position and said third position whereby a deforming force is applied by said forming ring means against the can bottom during said ram movement from said second position to said third position.

The present invention may also include a method of forming a dome in the bottom of a can body comprising the steps of: deformably engaging a portion of the can bottom associated with an outer peripheral portion of the dome to be formed with an annular surface having substantially the same shape as the outer peripheral portion of the dome to be formed; subsequently engaging a portion of the can associated with an inner portion of the dome to be formed with a separate spheroid surface of substantially the same shape as the inner portion of the dome to be formed; continually applying pressure to an outer peripheral portion of the can bottom during deforming engagement of said can bottom by both said annular surface and said spheroid surface.

The present invention may also include a can body comprising: a generally cylindrical sidewall; and a bottom wall integrally formed with said sidewall having an outwardly concave dome therein having a peripheral dome surface formed by an annular forming surface and a central dome surface formed by a separate spheroid forming surface.

DETAILED DESCRIPTION OF THE INVENTION

Figure 1:
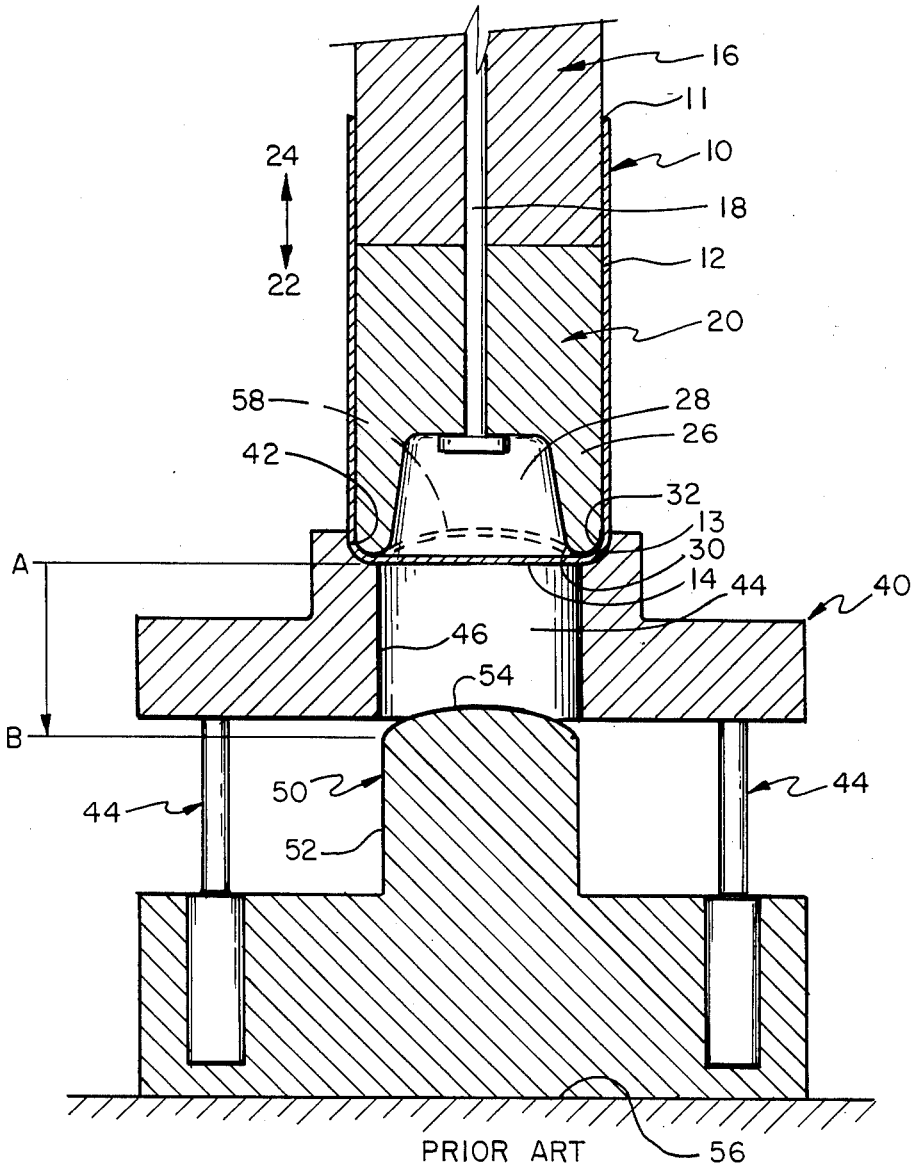
FIG. 1 is a schematic cross sectional elevation view of a prior art can doming assembly.

A can doming device of the prior art is represented schematically in FIG. 1. A can body 10 to be domed has an open top end 11 defining a circular opening, a cylindrical side wall 12 and a closed circular bottom wall 14 integrally connected to the side wall at a relatively small radius annular shoulder portion 13. The can body 10 is mounted about an axially extending cylindrical bodymaker punch 20 of approximately the same external diameter as the internal diameter of the can. The bodymaker punch is in turn mounted on an axially extending ram 16 as by a bolt 18. The bodymaker punch and the can 10 mounted thereon are axially reciprocally movable by ram 16 in a first horizontal direction 22 and a second opposite horizontal direction 24. The bodymaker punch 20 comprises an annular peripheral rim portion 26 defined by an interior cavity 28 provided at the terminal end of the bodymaker punch 20. Rim portion 26 has a rounded terminal end portion 30 which engages an interior peripheral portion 32 of the can shoulder 13 and bottom 14. Bodymaker punch 20 urges the can bottom and shoulder against external pressure ring 40 and, subsequently, urges the can bottom against stationary domer die 50 as the ram moves in direction 22. The external pressure ring 40 which engages the can body 10 has an inner peripheral recessed ring portion defined by an inwardly facing concave surface 42 adapted to, ordinarily, nondeformingly engage an outer peripheral portion of the can bottom 14, can shoulder 13 and a lower portion of side wall 12. The external pressure ring 40 is mounted on a plurality of biasing air cylinders 44 which enable the pressure to be moved with can body 10 in the direction 22 as the can bottom 14 moves from an initial engagement position A to a position B associated with maximum ram movement in direction 22. Pressure ring 40 has a central cylindrical opening 44 defined by interior surface 46 which is adapted to receive domer die 50 in close sliding relationship therewithin. Domer die 50 is fixedly mounted on a stationary base surface 56 and remains stationary throughout the doming operation. Domer die 50 has a generally circular sidewall surface 52 and terminates in a constant radius dome-shaped, sometimes herein referred to as "spheroid," end surface 54. As the can engages stationary domer die 50 during its movement in direction 22, the domer die end surface 54 engages the bottom wall 14 forcing it into a dome-shaped configuration 58, shown in phantom, of substantially the same shape as the terminal surface 54 of the domer die 50. An outer generally flat surfaced peripheral bottom ring 60 is also thus provided in the bottom wall by the doming operation. Bottom ring 60 provides a stable support base for the can.

Figure 2:
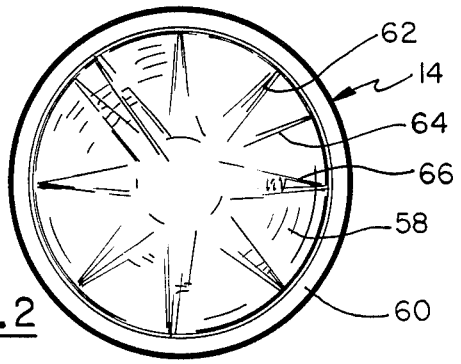
FIG. 2 is a bottom view of a domed can bottom having radial crease lines therein.

Earlier can doming assemblies did not include an external pressure ring 40. However such earlier can domers produced undesirable radially extending creases 62, 64, 66, etc., in the domed can bottom as illustrated in FIG. 2. Such a creased dome bottom is known in the art as a "flower dome." Such crease formation is aesthetically undesirable and also weakens the domed can bottom. Another undesirable effect of such doming without an external pressure ring is that metal in the can body side wall 12 tends to flow into the dome region 58 as it is being formed thereby shortening the axial length of the can body 10. It was to overcome the effects of can shortening and flower dome formation that pressure rings such as shown in FIG. 1 were introduced. The pressure ring 40 engages the bottom periphery of the can body prior to the can's engaging the stationary domer die 50. The pressure ring applies sufficient pressure against the engaged portion of the can body to limit the metal flow conditions associated with can shortening and, to some extent, stabilizes the can bottom circumferentially to prevent flower dome formation. Although such an external pressure ring 40 may be relatively effective in preventing flower dome formation and can shortening, it has been found that in many cases the biasing pressure which must be applied by the pressure ring against the can bottom to prevent such problems may itself be damaging to the engaged portion of the can bottom.

The can doming assembly 100 of the present invention also prevents flower dome formation and can shortening but is much less likely to damage the lower portion of a can than prior art pressure rings.

As illustrated by FIGS. 3 through 6, the can doming die punch assembly 100 of the present invention is adapted fo operating on a can body 110 of a type having an open top end 111, a cylindrical side wall 112, a generally flat bottom wall 114, and a relatively short length short radius annular shoulder 113 connecting the side wall and bottom wall. The can doming die punch assembly 100, in general, comprises a bodymaker punch 120 mounted as by a bolt 118 on a reciprocating ram unit 116 adapted to reciprocally move in a first horizontal direction 122 towards a domer die 180 and a second opposite horizontal direction 124 away from the domer die; a forming ring 140 adapted to formingly engage an inwardly positioned annular band portion 187 of the bottom wall 114 to provide a peripheral portion 203 of a dome 201 to be formed in the can bottom wall; and a fixed domer die 180 adapted to engage a central circular portion 189 of bottom wall 114 to form an inner dome portion 208 of the dome 201 to be formed in bottom wall 114; and biasing means such as air cylinders 194, 196 adapted to provide a constant relatively low biasing pressure in a direction 124 as the forming ring 140 moves in direction 122 during can dome formation.

Figure 3:
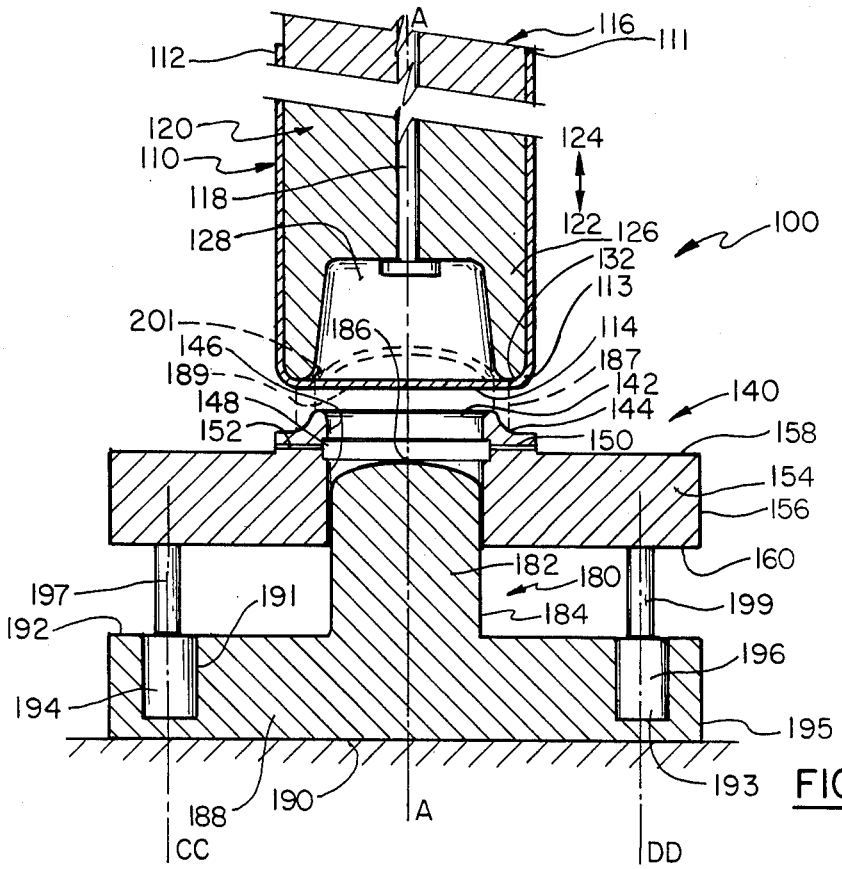
FIGS. 3 through 6 are schematic cross sectional elevation views of a can doming assembly of the present invention showing various operating positions thereof.
Figure 4:
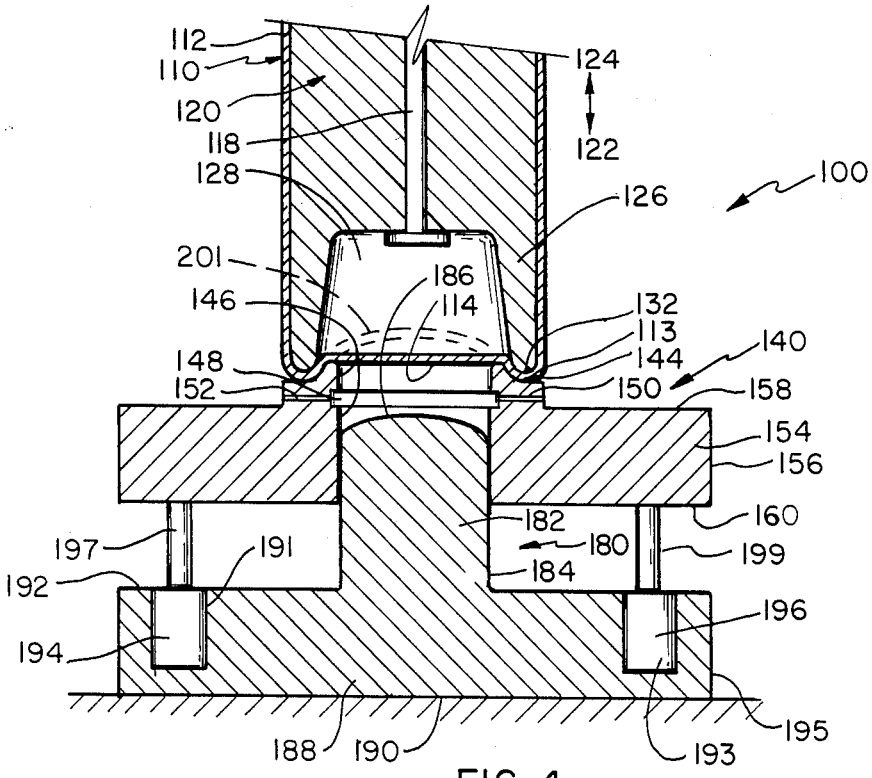
Figure 5:
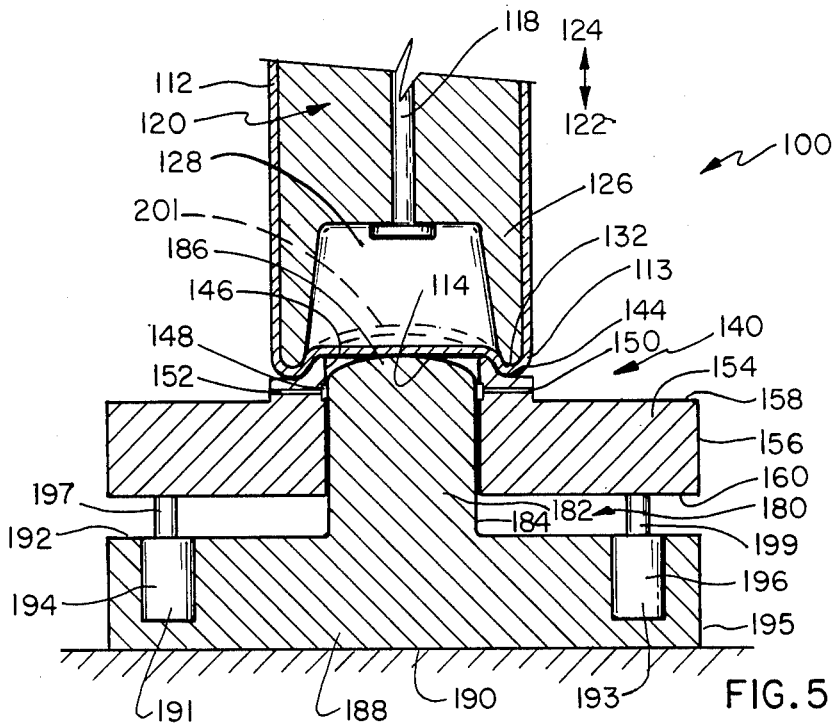
Figure 6:
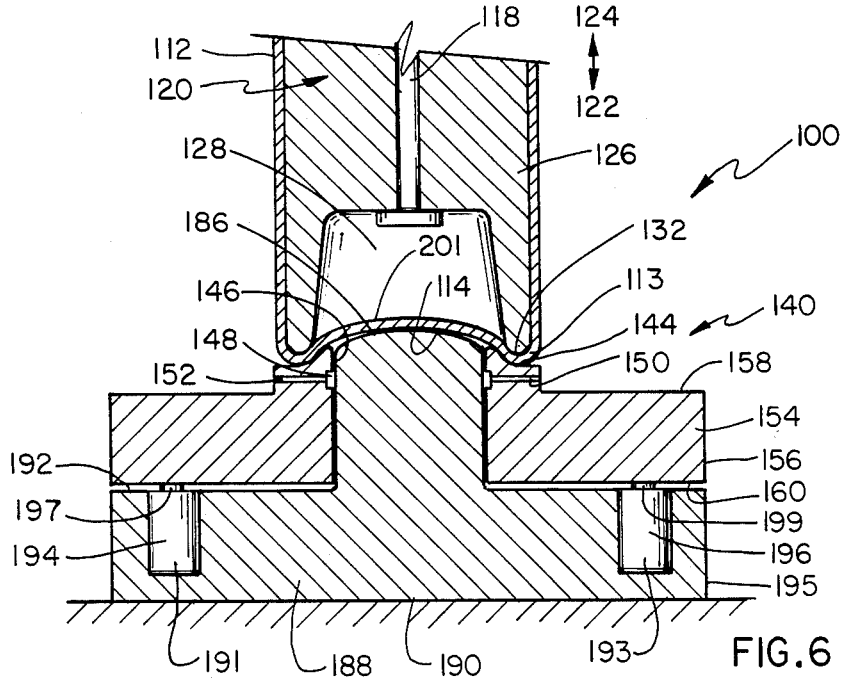

In operation ram 116 and attached bodymaker punch 120 move can body 110 in direction 122 from an initial position in spaced relationship from forming ring 140 and domer die 180 as shown in FIG. 3. Can bottom wall 114 is initially engaged by annular surface 144 of forming ring 140. Ram 116 and bodymaker punch 120 subsequent to engagement of bottom wall 114 by surface 144 continue moving in direction 122 while forming ring 140 initially remains in a fixed position. The continued movement of the bodymaker punch and associated can 110 thus cause deformation of the can bottom 114 in the area engaged by the forming ring 140. Forming ring 140 remains relatively fixed until the bodymaker punch 120 and can body 110 have moved into the position illustrated in FIG. 4 wherein the outer peripheral portion of the can bottom is forced into engagement with a radially outer peripheral portion of forming ring surface 144. Thereafter further movement of the bodymaker punch 120 is accompanied by movement of the forming ring 140 in the same direction (122) and at the same relative rate. As illustrated in FIG. 5 this downward movement of forming ring 140 causes the central portion of the can bottom 114 to subsequently be engaged by an upper dome-shaped surface 186 of domer die 180. Subsequent movement to a position illustrated in FIG. 6, which represents the furthest extension of ram 116 in direction 122, causes the can bottom 114 to be further deformed by the domer die 100 to complete the formation of a dome 201 having a relatively constant radius and composed of a first dome portion 203 formed by the forming ring 140 and a second portion 208 formed by the domer die 180. Having thus described the invention in general further specific features of the invention will now be described.

Figure 7:
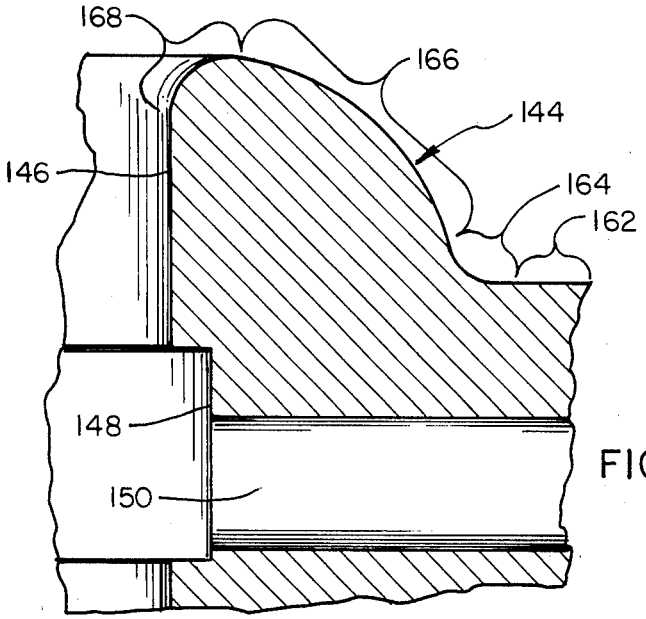
FIG. 7 is a detailed cross sectional elevation view of a portion of a forming ring of the type illustrated in FIGS. 3 through 6.
Figure 8:
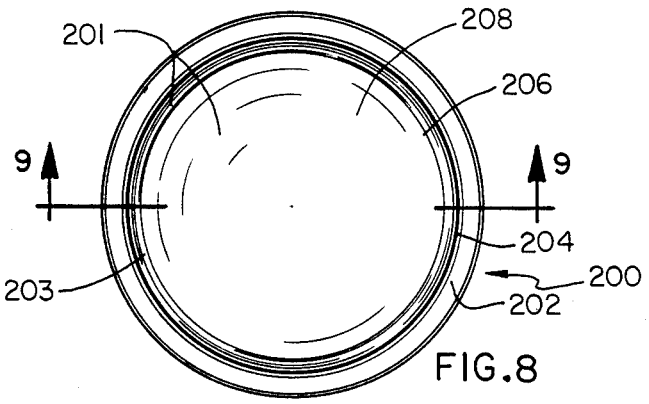
FIG. 8 is a bottom view of a domed can bottom of the type formed by the apparatus illustrated in FIGS. 3 through 7.
Figure 9:
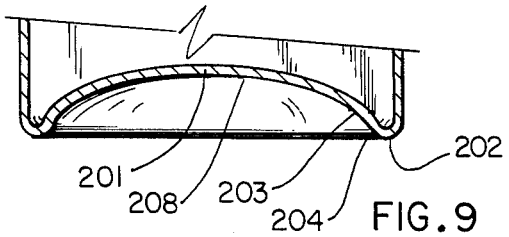
FIG. 9 is a cross sectional elevation view of the domed can bottom of FIG. 8.

As illustrated in FIGS. 3 through 7, forming ring 140 comprises an annular can bottom engaging portion 142 having an outwardly facing generally outwardly convex can bottom engaging annular surface 144. The forming ring also comprises an internal cylindrical surface 146 adapted to slidingly accept the domer die 180 therewithin; and a recessed annular fluid discharge ring 148 adapted for collecting lubricating fluid and gases trapped between the can bottom 114 and various surfaces of the forming ring and domer die and having associated therewith axially extending fluid discharge passages 150, 152, etc. for expelling such collected fluids. The forming ring also comprised an outer body portion 154 having a cylindrical outer surface 156 and a pair of opposite radially extending surfaces 158, 160. As illustrated in FIG. 7 the outwardly facing generally convex can bottom engaging annular surface 144 may include a generally planar radially extending surface portion 162 extending perpendicular to the direction of ram reciprocation and associated with an outer peripheral support ring portion 202 of the can bottom 200 being formed. Surface 144 also comprises an outwardly facing, concave, relatively short length, small radius (0.05 in.), annular transition surface portion 164 which is associated with a can bottom transition surface 204 and which connects surface 162 to an outwardly facing, relatively large radius (0.219 in.), convex surface portion 166 which is associated with a peripheral portion 203 of the can dome 201 to be formed. Surface 166 is integrally connected to axially extending cylindrical surface 146 by radially inwardly facing, small radius (0.05 in.), convex shoulder portion 168.

Domer die 180 which is positioned in axially aligned relationship with bodymaker punch 120 comprises a main cylindrical body portion 182, having a cylindrical side wall 184 having a diameter, e.g. 1.736 in., about 30% less than the can body diameter, e.g. 2.50 in. and a dome shaped terminal end surface 186 which may have a radius approximately equal to the can diameter, e.g. 2.50 in., Domer die 180 also comprises a base portion 188 having a radially extending surface 190 affixed to a support surface and opposite radially extending surface 192 connected by a outer cylindrical wall portion 195. Biasing means such as air cylinders 194, 196 may have barrel portions 191, 193 mounted in recessed portions of the radially extending base portion 188 and may have piston portions 197, 199 attached to outer radial portions of forming ring 140. The air cylinders 194, 196, etc. having central longitudinal axes CC, DD extending parallel to the central longitudinal axis AA of the bodymaker punch 120 and domer die 180. Of course the biasing air cylinders 194, 196 may be replaced by conventional biasing springs or other biasing means. A surprising feature of the can doming die punch assembly 100 of the present invention is that the pressure exerted by the forming ring surface 144 against the can bottom during doming may be significantly less, approximately an order of magnitude less, than the pressure exerted by a conventional pressure ring 40 against an associated can bottom during dome formation by conventional prior art techniques. For example, in the formation of a conventional aluminum beer can having a diameter of approximately 2.50 inches, a force of approximately 50 lbs. on the can bottom wall is sufficient to prevent axial can shortening and flower dome formation when using a can doming die punch assembly 100 of the present invention; whereas a force of approximately 900 lbs. must be exerted by a conventional pressure ring 40 against a can bottom to prevent axial shortening and flower dome formation. Thus the present invention is much less likely to damage a can bottom than prior art apparatus such as described in FIG. 1.

It is contemplated that the inventive concepts herein described may be variously otherwise embodied and it is intended that the appended claims be construed to include alternative embodiments of the invention except insofar as limited by the prior art.

What is claimed is:

1. A can doming assembly for producing a dome in the bottom wall of a thin walled can body of the type having an open top, a cylindrical sidewall and a generally planar bottom wall integrally formed with the sidewall, the sidewall and bottom wall each having an interior surface and an exterior surface, and for preventing the formation of radially extending crease lines in the can bottom wall during dome formation, and for preventing damage to the can bottom wall of the type associated with application of a large magnitude force thereto, comprising:

punch means insertable into the can body through the open top thereof and having a punch cavity whereby the punch is engageable only with the interior surface of the can bottom wall at a peripheral portion of the can bottom wall for urging the can bottom wall against a forming ring means and a domer die means;

forming ring means positioned axially adjacent said punch means for deformingly engaging the exterior surface of the can bottom wall at a circular band portion thereof for forming an outer peripheral portion of a dome in the can bottom wall;

domer die means positioned axially adjacent said forming ring means for engaging the exterior surface of the can bottom wall at a central circular portion thereof for forming a central portion of a dome in the can bottom wall;

ram means attached to said punch means for reciprocally moving said punch means in a first direction toward said domer die means and a second direction away from said domer die means, said ram means having a first position wherein a can engagedly mounted on said punch means is positioned in axially spaced relationship from said forming ring means and in axially spaced relationship with said domer die means, and a third position wherein a can engagedly mounted on said punch means is positioned in engaged relationship with both said forming ring means and said domer die means;

forming ring biased support means for holding said forming ring at a position between said punch means and said domer die means in axially spaced relationship therefrom when said ram means is in said first position and for enabling axial movement of said forming ring means in said first direction during movement of said ram means between said second position and said third position and for exerting a biasing force on said forming ring means in said second direction during movement of said ram means between said second position and said third position whereby a deforming force is applied by said forming ring means against the can bottom during said ram movement from said second position to said third position;

said forming ring means coacting with said punch means and said domer die means for preventing the formation of radially extending crease line during formation of the dome in the can bottom wall;

said forming ring biased support means exerting a relatively low biasing force on said forming ring means whereby a relatively small force is exerted on said can bottom wall whereby can bottom wall damage of the type caused by application of a large force thereto is prevented.

2. The invention of claim 1 wherein said forming ring means comprises:

an annular engagement surface for engaging the can bottom; and a central cylindrical surface defining a central cylindrical opening for slidingly receiving said domer die means therein.

3. The invention of claim 2 wherein said annular engagement surface comprises a radially outwardly facing, outwardly convex surface portion for engaging said circular band portion of the can bottom wall and for forming said outer peripheral portion of said dome in the can bottom wall; and a generally planar surface portion positioned radially outwardly of said outwardly convex surface portion and axially opposite said peripheral portion of the can bottom wall engaged by said punch means for coacting with said punch means for limiting the depth of penetration of the can bottom wall by said outwardly convex surface and for forming a peripheral support ring on said can bottom.

4. The invention of claim 3 wherein said domer die means comprises:

a substantially constant radius spheroid surface engageable with said can bottom for forming said central portion of the dome; and a cylindrical sidewall surface having a diameter adapted to be closely slidingly received by said cylindrical opening in said forming ring.

5. The invention of claim 4 wherein said outwardly convex surface of said forming ring means comprises a substantially identical length radius of curvature to the radius of curvature of said domer die spheroid surface whereby the dome in the can bottom wall formed by said forming ring means and said domer die means comprises a substantially constant radius of curvature and further comprising:

stop means operatively associated with said domer die for limiting the axial movement of said domer die relative said forming ring means for limiting the penetration of said domer die into said can bottom to a depth whereat said dome portion formed by said domer die means forms a substantially continuous surface with said dome portion formed by said annular forming ring means whereby a substantially continuous substantially constant radius domed surface is provided.

6. The invention of claim 5 wherein said stop means is provided by abuttingly engageable surfaces of said forming ring means and said domer die means.

7. The invention of claim 3 wherein said forming ring comprises an annular, radially inwardly facing, convex shoulder surface connecting said central cylindrical surface and said radially outwardly facing outwardly convex surface portion of said annular engagement surface.

8. The invention of claim 7 wherein said convex shoulder surface has a radius of curvature of approximately 0.05 inches.

9. The invention of claim 7 wherein said annular engagement surface comprises an annular transition surface connecting said convex surface portion and said planar surface portion for forming a transition portion of said can bottom located between said dome and said peripheral support ring in said can bottom wall.

10. The invention of claim 1 wherein said biasing force exerted on said forming ring means by said forming ring biased support means is substantially less than the force exerted by a conventional pressure ring against a can bottom in a conventional doming operation on a can body of similar construction, whereby damage to said can bottom from excessive force is prevented.

11. The invention of claim 10 wherein said biasing force is approximately an order of magnitude less than said force exerted by a conventional pressure ring against a can bottom.

12. The invention of claim 1 wherein said can body comprises a conventional aluminum beer can body having a diameter of approximately 2.50 inches and being of the type requiring a conventional pressure ring force of approximately 900 lbs. to be exerted against the bottom wall thereof during bottom doming with a conventional pressure ring-type doming assembly; and wherein said biasing force exerted on said forming means by said forming ring biased support means is approximately an order of magnitude less than 900 lbs.

13. The invention of claim 1 wherein said biasing force exerted on said forming ring means by said forming ring biased support means is on the order of 50 lbs., whereby damage to said can bottom associated with application of a large force thereto is prevented.

14. A method of forming an upwardly arching dome in the bottom wall of a can body of the type having an open top, a cylindrical sidewall, and a generally planar bottom wall integrally formed with the sidewall, comprising the steps of:

initially deformably engaging a portion of the can of a forming ring having substantially the same shape as the outer peripheral portion of the upwardly arching dome to be formed;

then limiting deforming penetration of said can bottom by said annular surface by engagement of said can bottom with a generally planar annular surface portion of said forming ring;

then engaging a portion of the can associated with an inner portion of the dome to be formed with a separate spheroid surface of substantially the same shape as the inner portion of the dome to be formed.

15. The invention of claim 14 comprising the step of:

continually applying force to an outer peripheral portion of the can bottom with said generally planar surface subsequent to deformation of said can bottom wall by said annular surface and during deforming engagement of said can bottom wall by said spheroid surface.

16. The invention of claim 15 wherein the step of applying force to the can bottom comprises applying a force in the order of magnitude of 50 lbs.

* * * * *

UNITED STATES PATENT AND TRADEMARK OFFICE

CERTIFICATE OF CORRECTION

PATENT NO. : 4,723,433

DATED : February 9, 1988

INVENTOR(S) : CONRAD M. GRIMS

It is certified that error appears in the above-identified patent and that said Letters Patent are hereby corrected as shown below:

Column 4, line 64, "adapted fo" should read --adapted for--.

Column 5, line 44, "domer die 100" should read -- domer die 180--.

In the Claims:

Claim 1, Column 7, line 28, after "means", insert --and said domer die means, a second position wherein a can engagedly mounted on said punch means is positioned in engaged relationship with said forming ring means--.

Claim 14, Column 9, line 22, after "of the can", insert --bottom associated with an outer peripheral portion of the dome to be formed with an annular surface portion--.

Signed and Sealed this

Nineteenth Day of July, 1988

*Attest:*

*Attesting Officer*

DONALD J. QUIGG

*Commissioner of Patents and Trademarks*